US008007381B2

(12) United States Patent
Watari et al.

(10) Patent No.: US 8,007,381 B2
(45) **Date of Patent: *Aug. 30, 2011**

(54) BAT USED FOR BASEBALL OR SOFTBALL

(75) Inventors: Makoto Watari, Yokohama (JP); Koji Yoshida, Yokohama (JP)

(73) Assignee: Nippon Shaft Co., Ltd., Yokohama-shi, Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/878,935

(22) Filed: Jul. 27, 2007

(65) Prior Publication Data

US 2008/0070726 A1 Mar. 20, 2008

(30) Foreign Application Priority Data

Jul. 28, 2006 (JP) ..... 2006-206829

(51) Int. Cl.
*A63B 59/06* (2006.01)

(52) U.S. Cl. ..... 473/566; 473/567

(58) Field of Classification Search ..... 473/457, 473/519, 520, 564–568
See application file for complete search history.

(56) References Cited

U.S. PATENT DOCUMENTS

| | | | | |
|---|---|---|---|---|
| 5,954,602 | A | 9/1999 | Eggiman et al. | |
| 6,776,735 | B1 | 8/2004 | Belanger et al. | |
| 6,808,464 | B1 * | 10/2004 | Nguyen | 473/566 |
| 6,872,156 | B2 * | 3/2005 | Ogawa et al. | 473/567 |
| 6,875,137 | B2 * | 4/2005 | Forsythe et al. | 473/566 |
| 6,969,330 | B1 | 11/2005 | Meeker | |
| 7,014,580 | B2 | 3/2006 | Forsythe et al. | |
| 7,033,291 | B1 | 4/2006 | Meeker | |
| 7,128,670 | B2 * | 10/2006 | Souders et al. | 473/567 |
| 7,361,107 | B2 | 4/2008 | Giannetti et al. | |
| 7,534,180 | B1 | 5/2009 | Vacek et al. | |
| 7,749,115 | B1 | 7/2010 | Cruz et al. | |
| 7,850,554 | B2 | 12/2010 | Burger | |
| 7,867,114 | B2 | 1/2011 | Sutherland et al. | |
| 2002/0091022 | A1 * | 7/2002 | Fritzke et al. | 473/566 |
| 2002/0094892 | A1 | 7/2002 | Chauvin et al. | |
| 2003/0153416 | A1 | 8/2003 | Anderson | |
| 2004/0053716 | A1 | 3/2004 | Wu | |

(Continued)

FOREIGN PATENT DOCUMENTS

JP 05-057042 3/1993

(Continued)

OTHER PUBLICATIONS

Japanese Office Action (Application No. 2009-030362) dated Jun. 1, 2010 with English partial translation.

(Continued)

*Primary Examiner* — Mark Graham
(74) *Attorney, Agent, or Firm* — Nixon Peabody, LLP; Jeffrey L. Costellia

(57) ABSTRACT

A bat used for baseball or softball includes a bat body including a grip part, a taper part and a first tube, a fixing component including a first fixing component and a second fixing component and a cylindrical second tube having two opened ends, the inner diameter of the cylindrical second tube being larger than the diameter of the first tube, the second tube being placed on the outer circumference of the first tube and being latched so that a gap is formed between the bat body and the second tube via the first fixing component and the second fixing component.

18 Claims, 15 Drawing Sheets

THE LONGITUDINAL DIRECTION NOTCH SECTIONAL VIEW

U.S. PATENT DOCUMENTS

| | | | | |
|---|---|---|---|---|
| 2004/0224802 | A1 | 11/2004 | Forsythe et al. | |
| 2006/0258490 | A1 * | 11/2006 | Fitzgerald et al. | 473/564 |
| 2008/0070726 | A1 | 3/2008 | Watari et al. | |
| 2009/0280934 | A1 | 11/2009 | Watari et al. | |
| 2009/0280935 | A1 | 11/2009 | Watari et al. | |
| 2010/0125014 | A1 | 5/2010 | Watari et al. | |
| 2011/0105255 | A1 | 5/2011 | Watari et al. | |

FOREIGN PATENT DOCUMENTS

| | | |
|---|---|---|
| JP | 11-137752 | 5/1999 |
| JP | 2001-079131 | 3/2001 |
| JP | 2003-019236 | 1/2003 |
| JP | 2004-267478 | 9/2004 |
| JP | 2005-245943 | 9/2005 |
| JP | 2005-305146 | 11/2005 |
| JP | 2008-029620 | 2/2008 |
| JP | 57-185374 | 6/2010 |
| WO | WO 00-23151 | 4/2000 |

OTHER PUBLICATIONS

Japanese Office Action (Application No. 2009-030362) dated Aug. 31, 2010 with English partial translation.

Office Action of co-pending (U.S. Appl. No. 12/494,357) mailed Jan. 12, 2011.

* cited by examiner

THE LONGITUDINAL DIRECTION NOTCH SECTIONAL VIEW

LINE α − α' SECTIONAL VIEW

THE LONGITUDINAL DIRECTION NOTCH SECTIONAL VIEW

LINE β − β' SECTIONAL VIEW

THE LONGITUDINAL DIRECTION NOTCH SECTIONAL VIEW

THE DIRECTION OF A HIT BALL OF THE CONVENTIONAL HYBRID TYPE BAT

THE DIRECTION OF A HIT BALL OF THE BAT CONCERNING THE 1st EMBODIMENT OF THIS INVENTIONS

PRIOR ART

THE LONGITUDINAL DIRECTION NOTCH SECTIONAL VIEW

PRIOR ART

LINE A-A' SECTIONAL VIEW

PRIOR ART

THE LONGITUDINAL DIRECTION NOTCH SECTIONAL VIEW

PRIOR ART

LINE B–B' SECTIONAL VIEW (a) Bat Specs

| Bat No. | Weight [g] | Length [mm] | Body | | | Insertion Tube | | | Gap [mm] | Barycentric Position [mm] | Inertia Moment [kgm$^2$]* |
|---|---|---|---|---|---|---|---|---|---|---|---|
| | | | Material | External Diam. [mm] | Thickness [mm] | Material | External Diam. [mm] | Thickness [mm] | | | |
| 1 | 724.7 | 810 | A7000 series | 57.0 | 2.00 | -- | -- | -- | | 416 | 0.0679 |
| 2 | 732.1 | 840 | A7000 series | 50.0 | 1.25 | A7000 series | 57.0 | 1.25 | <2.50 | 517 | 0.1213 |
| 3 | 855.3 | 840 | A7000 series | 51.0 | 1.65 | A7000 series | 57.0 | 1.25 | <2.00 | 520 | 0.1438 |
| 4 | 726.9 | 840 | A7000 series | 57.0 | 1.25 | A7000 series | 54.0 | 1.55 | <0.50 | 517 | 0.1203 |

Bat No. 1 .....conventional single layer bat
Bat No. 2 .....double layer bat relating to one embodiment of present invention (a body of closing in)
Bat No. 3 .....double layer bat relating to one embodiment of present invention (a thick body)
Bat No. 4 .....conventional inner tube reinforced type double layer bat
*inertia moment at a position 110 mm from bat end (b) Meet Ratio

| | Bat No. 1 | | | Bat No. 2 | | | Bat No. 3 | | | Bat No. 4 | | |
|---|---|---|---|---|---|---|---|---|---|---|---|---|
| | H/S** | B/S** | Meet Ratio | H/S | B/S | Meet Ratio | H/S | B/S | Meet Ratio | H/S | B/S | Meet Ratio |
| 1 | 31.1 | 29.4 | 0.945 | 32.0 | 33.8 | 1.056 | 29.6 | 32.4 | 1.095 | 30.7 | 29.8 | 0.971 |
| 2 | 31.3 | 30.1 | 0.962 | 32.2 | 34.4 | 1.068 | 30.2 | 31.6 | 1.046 | 30.9 | 29.0 | 0.939 |
| 3 | 31.5 | 38.9 | 0.917 | 32.3 | 33.6 | 1.040 | 31.0 | 31.0 | 1.000 | 29.4 | 30.6 | 1.041 |
| 4 | 31.2 | 28.4 | 0.910 | 29.8 | 31.9 | 1.070 | 29.2 | 30.0 | 1.027 | 30.0 | 31.0 | 1.033 |
| 5 | 32.4 | 30.3 | 0.935 | 30.0 | 32.0 | 1.067 | 28.2 | 30.5 | 1.082 | 31.5 | 30.2 | 0.959 |
| 6 | 31.4 | 29.8 | 0.949 | 30.6 | 31.0 | 1.013 | 28.6 | 30.8 | 1.077 | 31.5 | 30.8 | 0.978 |
| 7 | 31.1 | 30.3 | 0.974 | 30.6 | 31.5 | 1.029 | 29.0 | 29.0 | 1.000 | 29.9 | 30.1 | 1.007 |
| 8 | 31.9 | 31.8 | 0.997 | 32.1 | 34.2 | 1.065 | 29.9 | 31.2 | 1.043 | 29.8 | 30.3 | 1.017 |
| 9 | 31.4 | 30.1 | 0.959 | 31.6 | 32.2 | 1.019 | 28.3 | 29.7 | 1.049 | 30.0 | 30.2 | 1.007 |
| 10 | 30.5 | 29.7 | 0.974 | 31.8 | 33.7 | 1.060 | 29.0 | 29.7 | 1.024 | 29.7 | 30.7 | 1.034 |
| Average | 31.4 | 29.9 | 0.952 | 31.3 | 32.8 | 1.049 | 29.3 | 30.6 | 1.044 | 30.3 | 30.3 | 0.998 |

**Meet Ratio: ball speed / swing speed
**using rubber softball No. 3 by tee-batting method
**H/S head speed (bat speed ratio to the impact of bat and ball) [n/S]
**B/S ball speed (ball speed after the impact of bat and ball) [n/S]
**measured using each bat and using tee batting 10 times respectively under the above conditions

FIG. 10

FIG. 11

(a) Relative Meet Ratio (as opposed to bat No. 1)

| | Meet Ratio | Meet Rate Ratio % |
|---|---|---|
| Bat No. 1 | 0.952 | 1.0000 |
| Bat No. 2 | 1.049 | 1.1019 |
| Bat No. 3 | 1.044 | 1.0966 |
| Bat No. 4 | 0.998 | 1.0483 |

Meet Rate Ratio : Ratio to the Meet Ratio of Bat No. 1

Bat No. 1.....conventional single layer bat
Bat No. 2.....double layer bat relating to one embodiment of present invention (a body of closing in)
Bat No. 3.....double layer bat relating to one embodiment of present invention (a thick body)
Bat No. 4.....conventional inner tube reinforced type double layer bat (b) Meet Ratio

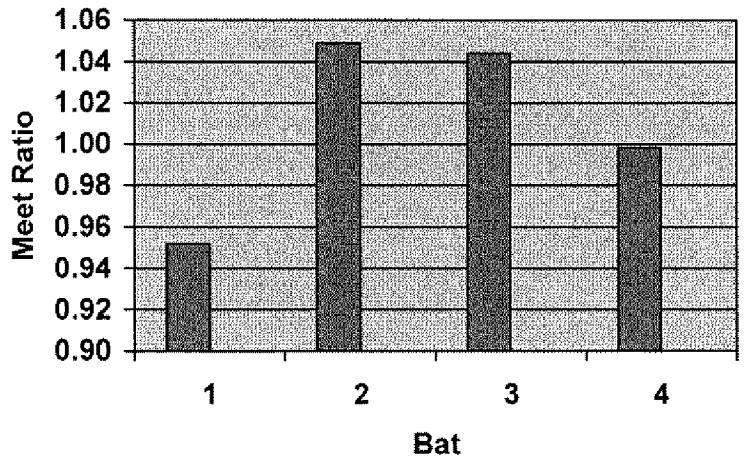

(c) Meet Rate Ratio (as opposed to bat No. 1)

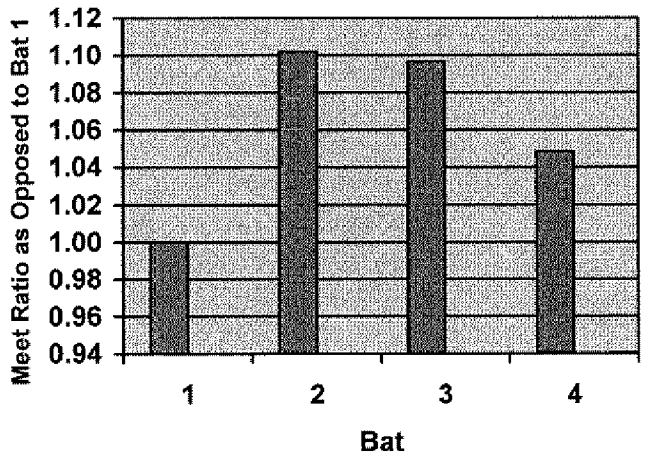

BAT USED FOR BASEBALL OR SOFTBALL

CROSS REFERENCE TO RELATED APPLICATION

This application is based upon and claims the benefit of priority from the prior Japanese Patent Applications No. 2006-206829, filed on Jul. 28, 2006; the entire contents of which are incorporated herein by reference.

BACKGROUND OF THE INVENTION

1. Field of the Invention

This invention relates to the improvement of the rebound properties of a bat used for baseball or softball.

2. Description of the Related Art

In recent times, in order to expand the durability of a metal bat, as shown in Japanese Laid Open Patent H05-57042, attempts at doubling the exterior or interior (exterior tube is called outer tube and interior tube is called inner tube) of the metal bat body by further arranging a metal tube have been made. This is known as a two layered bat. This aims to improve the strength of the bat by latching together the outer or inner tube with the body of the bat with no gap by a process such as swaging. In addition, the flight distance of a conventional ball which is hit by a bat such as a bat which is strong and has excellent rebound properties is thought to be extended, however, actually, it is known that when the ball and bat impact, consumption of the impact energy as ball transformation energy is suppressed, moreover, the higher the rebound force of the bat itself the further the flight distance of the ball is extended. Consequently, as shown in Japanese Laid Open Patent 2001-79131, it is attempted to extend the flight distance of the ball by forming and arranging a gap between the body of the bat and the outer tube or inner tube as a double layer bat and by bending of the close tube when the ball is hit the consumption of the impact energy as ball transformation energy is suppressed.

FIG. 8 is a notch sectional view in a longitudinal direction and a cross sectional view of the A-A' line across the width of one example of a conventional double layer bat. In FIG. 8, in general the bat body 10 is composed of a tip part 11, a part to be hit 12, a taper part 13 and a grip part 14, from the tip part 11 of said bat body 10 through to taper part 13 the outer tube is fitted and in taper part 13 the hollow for latching 70 which is arranged in the body of bat 10 is latched by the swaging process or spinning process. At this time, it is latched so that a fixed gap is arranged between the outer tube 20 and the bat body 10. Here, the grip 14 is the part which the batter grips and is the thinnest part of the bat body 10 which is extended at a predetermined length from the grip end, the taper part 13 is the part where the diameter gradually becomes bigger from the grip part. Also, the tip end part 11 is the part which is formed by a tip resin of the bat which is positioned furthest from the grip end. The part to be hit 12 is a part other than the grip part 14 of the bat body 10, taper part 13 and tip part 11 and is the part which is extended a predetermined length towards the bat tip from the widest part of the taper part 13 (in the case of a double layer bat, either an exterior or interior tube of a double construction at the part extended a predetermined length from the widest part of taper part 13 towards the tip of the bat). The part to be hit 12 is the part which is generally deemed to be suited to hitting a ball. Further, depending on the manufacturing method, the tip part 11 is sometimes integrally formed with the part to be hit 12 by metal and in this case, the bat body 10 is composed of a part to be hit 12, a taper part 13 and a grip part 14.

However, in a conventional double layer bat, even in the case where a metal tube is arranged on either the interior or exterior, it is necessary to latch the two tubes by swaging etc in the final process. In this case, in order to remove process distortions, following the swaging process, heat treatment is carried out and stress must be released. In the case where this process is not carried out, the strength of the processed part decreases and damage etc occurs because durability is extremely inferior. However, heat treatment of a double manufactured part is difficult to control and it is difficult to secure a sufficient level of strength and durability. In particular, in the case of using a tube for the outer tube or inner tube of a different material to the bat body, which is of titanium or titanium alloy which excels in rebound force, with the aim of securing flight distance, controlling this heat treatment is extremely difficult. Because, when the material of the outer tube or inner tube is different to that of the bat body, because each material's melting point is different, control of the heat treatment temperature and time becomes complex. Therefore, by the construction of a conventional double layer bat, a bat for use in baseball or softball which excels in durability and rebound force, absorbs the ball transformation energy and extends flight distance has not been proposed.

Further, in order to improve flight distance, as shown in, Japanese Laid Open Patent 2005-305146 a concave part is arranged in the metal bat and an attempt at forming a urethane layer on the concave part is made. This is known as a hybrid type double layer bat. FIG. 9 is a notch sectional view in a longitudinal direction and a cross sectional view of the B-B' line across the width of one example of a conventional hybrid type double layer bat. In FIG. 9, in general, the bat body 10 is composed of a tip part 11, a part where a ball is hit 12, a taper part 13 and a grip part 14. The part to be hit is smoothly made into a small diameter and a concave part is formed by a swaging process etc from the border between the tip part and the border between the taper part 13 heading towards the central side of the part to be hit 12. An elasticity urethane layer 101 is formed on this concave part so that it covers the body of the bat 10 and a further hard urethane layer 102 is formed on the outer circumference of the elasticity urethane layer 101. The hard urethane layer 102 is formed so that a surface of the hard urethane layer 102 flushes with a surface of the tip part 11 and a surface of the taper part 13. When the ball hits the hybrid type bat, the two layers of urethane (101 and 102) contract, suppress as much as possible the consumption of the impact energy as ball transformation energy and it is possible to extend the flight distance. However, because the urethane layers deteriorate as time passes, compared to a metal bat there is a problem whereby durability, unfortunately, is inferior.

Also, because the part to be hit 12 of the bat body 10 is covered by the two layers of urethane (101 and 102), in the case where a ball is struck in a place on the bat other than the sweet spot, the instances where what is called pop fly or a big ground ball hit with an incidence angle towards the ground increases. Because the diameter of the part to be hit 12 of the bat body 10, which becomes the sweetspot of the bat in the hybrid type two layer bat, is made smaller by a swaging process etc, compared to a usual single layer or double layer bat the diameter is narrow. The elasticity urethane layer 101 and the hard urethane layer 102 are formed on the this narrow body of the bat 10 so that they cover the bat body 10 and it becomes a bat which has the same diameter as that of a usual single layer or double layer bat. Therefore, when the sweetspot of the bat is missed and a ball hit, because the elasticity urethane layer 101 and the hard urethane layer 102 of the outer circumference contract when the ball impacts, actually, it is because it is the same as striking at a position which is close to the outer circumference part of the narrow body of the bat 10.

BRIEF SUMMARY OF THE INVENTION

A bat used for baseball or softball according to one embodiment of the present invention comprises a bat body including a grip part, a taper part and a first tube, a fixing component including a first fixing component, a second fixing component; and a cylindrical second tube having two open ends, the inner diameter of said cylindrical second tube being larger than the diameter of said first tube of said bat body, said second tube is placed on the outer circumference of said first tube of said bat body and is latched so that a predetermined gap is formed between said bat body and said second tube using said first fixing component and said second fixing component.

A bat used for baseball or softball according to one embodiment of the present invention comprises a bat body including a grip part, a taper part and a first tube, a fixing component including a first fixing component, a second fixing component and a third fixing component; and a plurality of cylindrical second tubes each having two open ends, the inner diameters of said plurality of cylindrical second tubes being larger than the diameter of said first tube of said bat body; at least one of said plurality of cylindrical second tubes being formed from a different material to those of the other cylindrical second tubes, said plurality of cylindrical second tubes being placed on the outer circumference of said first tube of said bat body and being latched so that gaps are formed between said bat body and said plurality of cylindrical second tubes via said first fixing component, said second fixing component and said third fixing component.

A method of manufacturing a bat used for baseball or softball according to one embodiment of the present invention comprises heating a bat body including a grip part, a taper part and a first tube, and a second tube separately, fixing a second fixing component to one end of said first tube with an adhesive, said end being located on a side of said taper part of said first tube, applying an adhesive to the exterior of said second fixing component, inserting said bat body inside of said second tube from the tip side of said bat body, applying an adhesive to one end of said first fixing component, and inserting said one end of said first fixing component between said second tube and said bat body so that a gap is formed via said first fixing component and said second fixing component between said second tube and said bat body.

BRIEF DESCRIPTION OF THE DRAWINGS

FIG. 10 illustrates the test results in a graph of the impact of a conventional single layer bat, an inner reinforced tube type double layer bat and a bat used for baseball of softball relating to the first embodiment of this invention.

FIG. 11 illustrates the impact test results shown in FIG. 10 in a bar graph.

DETAILED DESCRIPTION OF THE INVENTION

Figure 1A:
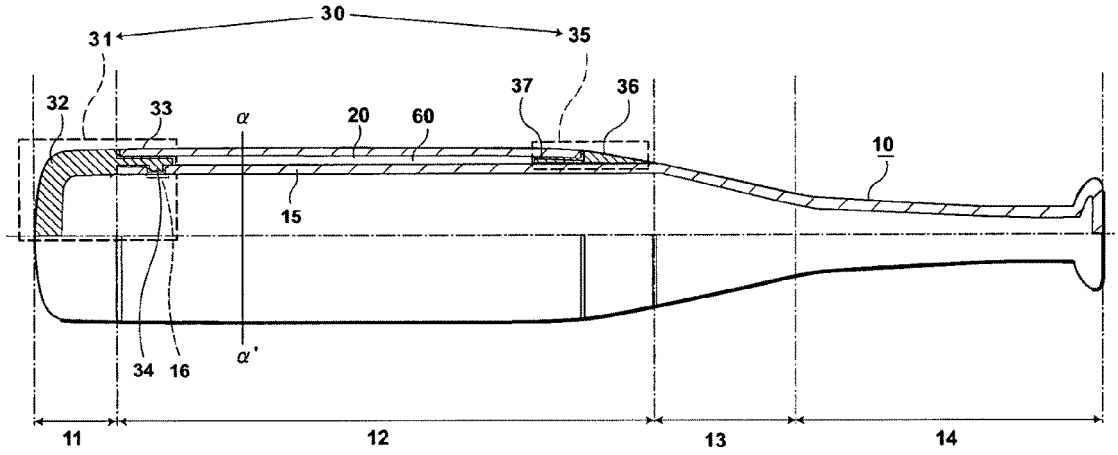
FIG. 1 is a notch sectional view in a longitudinal direction and a cross sectional view of the line α-α' across the width of the bat used for baseball or softball relating to the first embodiment of this invention.

Below, the examples of the present invention will be explained in detail while referring to the drawings.

Embodiment One

Figure 1B:
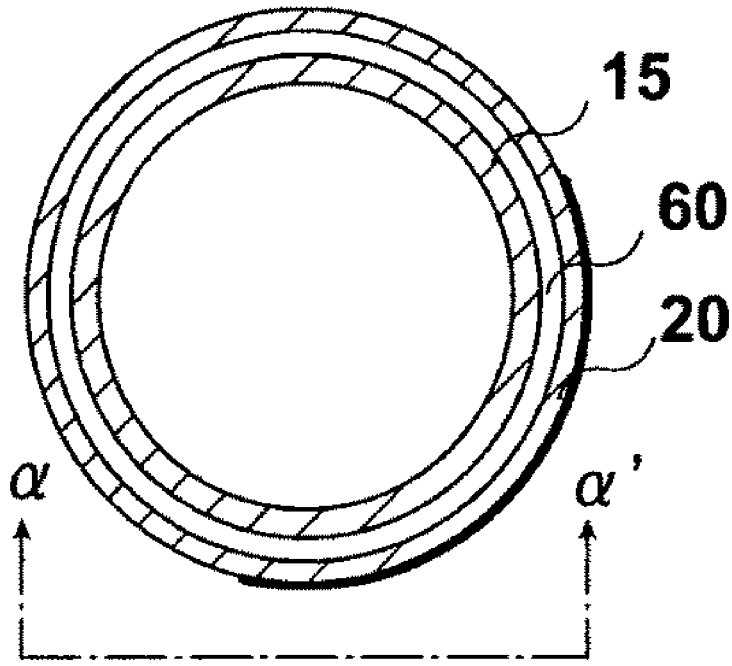

The bat used for baseball or softball relating to the first embodiment of this invention will be explained based on the drawings. FIG. 1 is a notch cross sectional view in a longitudinal direction and a cross sectional view across the width of a line α-α'. Further, in the embodiment, an example of a bat used for baseball or softball of this invention is shown and the bat used for baseball or softball of this invention is not limited to these embodiments.

In FIG. 1, the bat used for baseball or softball relating to the first embodiment of this invention comprises a bat body 10 which has a tip part 11, a first tube 15, a taper part 13 and a grip part 14, and a second tube 20 which is placed and latched on the outer circumference of the first tube 15 of the bat body, and a fixing component 20 which consists of a first fixing component 31 and a second fixing component 35. Further, in embodiment one of the present invention, the second tube 20 may be called outer tube 20.

In FIG. 1, the bat body 10 is a position which takes the lead when the batter hits a ball, and the batter grips the grip part 14, swings the bat body 10 and hits a thrown ball. The bat body 10, as stated above, consists of approximately 4 composed parts, a tip part 11, a first tube 15, a taper part 13 and a grip part 14 and, in order to secure strength and lightness, it is generally formed as one unit from an aluminum alloy or steel alloy etc. From the viewpoint of ease of processing and cost, as a material of the bat body 10, an aluminum allay related to A7000 such as aluminum alloy AA7050, AA7046 regulated by the American Aluminum Association Regulation is particularly preferred.

In embodiment one of the present invention the thickness of the bat body 10 is formed, for example, at a thickness of 1 mm-5 mm. The reason for this is to ensure overall lightness since the bat used for baseball or softball relating to embodiment one of the present invention has a second tube 20. After the bat body 10 is formed from metal as stated above, process distortions are removed and in order to secure a predetermined strength a series of heat treatment processes is carried out and following the release of stresses can be used. Further, the above stated thickness is an example and not limited to this.

In FIG. 1, the tip end 11 of the bat body 10 is composed by only the first fixing component 31 of the fixing components 30. The bat body 10 and the second tube 20 of the bat used for baseball or softball relating to embodiment one of this invention, are each manufactured by a different process and the second tube 20 is latched to the bat body 10 by the fixing components 30 consisting of the first fixing component 31 and second fixing component 35. Therefore, although there is no tip part on the bat body 10, when the first fixing component 31 of the fixing components 30 latches the second tube 20 it also performs the role of the tip part 11 of the bat body 10.

Following a hit the bat is generally thrown, however, when the bat body 10 hits the ground the tip part 11 is often the first part to hit the ground. The part to be hit 12 is an important part in hitting the ball and, for example, when this part hits a small stone etc on the ground if it changes shape the next hit is affected. The tip part 11 performs the role of protecting the part to be hit 12 by hitting the ground first rather than the part to be hit 12 of the bat body 10.

Because the bat used for baseball or softball relating to embodiment one of this invention shown in FIG. 1 is a double layer bat, the second pipe 20 placed on the outside and the first tube 15 of the bat body 10 placed on the inside become one unit and form the part to be hit 12. Therefore, the first tube 15 of the bat body 10 performs the role of hitting the ball together with the second tube 20.

In the bat used for baseball or softball relating to embodiment one of this invention, a gap 60 is maintained while the second tube 20 is latched by the fixing components 30 in the position of the outer circumference of the first tube 15 of the bat body 10. The ball directly hits the second tube 20. However, because a predetermined gap 60 is formed as stated above, when the ball is hit, because consumption of the hit energy as ball transformation energy is suppressed as much as possible by bending in the inner side of the second tube 20, flight distance is extended. The inner side of the second tube 20 bends and upon contacting with the first tube 15 of the bat body 10 the return force is rebound as rebound force. Therefore, the first tube 15 of the bat body 10 performs the supplemental role of and hitting the ball.

The taper part 13 of the bat body 10 is a part which performs a connecting role between the part to be hit 12 which has a fixed width in order to hit the ball and the grip part 14 which the batter grips and is formed so that the diameter gradually becomes larger in an opposite taper shape from the grip part 14 towards the bat tip. In the bat used for baseball or softball relating to embodiment one of the present invention the taper part 13 is formed as one unit with the first tube 15 and the grip part 14.

The grip part 14 of the bat body 10 is the part for the batter to grip, energy from both arms is transmitted to the grip 14 produced by the swing when the batter rotates their upper body with the hips as the center and the grip part 14 is a part which performs the important role of transferring the impact energy via the part to be hit 12 to the ball.

The second tube 20 is a cylindrical metal tube of a uniform diameter with both ends open and its full length corresponds approximately to the length of the first tube 15 of the bat body 10. Also, the inner diameter of the second tube 20 is larger than the outer diameter of the first tube 15. Further, the second tube 20 can be formed from an aluminum alloy or steel alloy like the bat body 10. Also, it can be formed by a phosphor bronze, copper alloy, gold alloy or platinum alloy. In the bat used for baseball or softball relating to embodiment one of this invention the second tube 20 is formed separately from the bat body 10, and is used after individual heat treatments. Therefore, as in the conventional double layer bat, because the bat is not heat treated in a state where the inner tube or outer tube is latched with the bat body, the difficulties of controlling heat treatment do not occur. Particularly, in the case where the material of the second tube 20 and the bat body 10 are different, control of heat treatment is extremely difficult, however, in embodiment one of this invention, these difficulties do not occur. Also, because the length of the second tube 20 corresponds approximately to that of the first tube 15 of the bat body 10, the amount of materials used is few and it is possible to use a high cost metal material such as titanium which has excellent rebound characteristics.

Further, while not shown in the drawings, a make up sheet can be applied to the outer circumference of the second tube 20 stated above for the purposes of damage resistance and external appearance design effects. Resin films, such as a polyethylene film or plastic film etc or sheet shaped FTP etc, can be used in the make up sheet.

The second tube 20 is joined to the bat body 10 using an adhesive 50 via the fixing components 30 and latched. The fixing components 30 are composed from a first fixing component 31 and a second fixing component 35, the first fixing component 31 is composed from a body part 32, an insertion part 33 and a protrusion part 34, and the second fixing component 35 is composed from a body part 36 and an insertion part 37.

Figure 2:
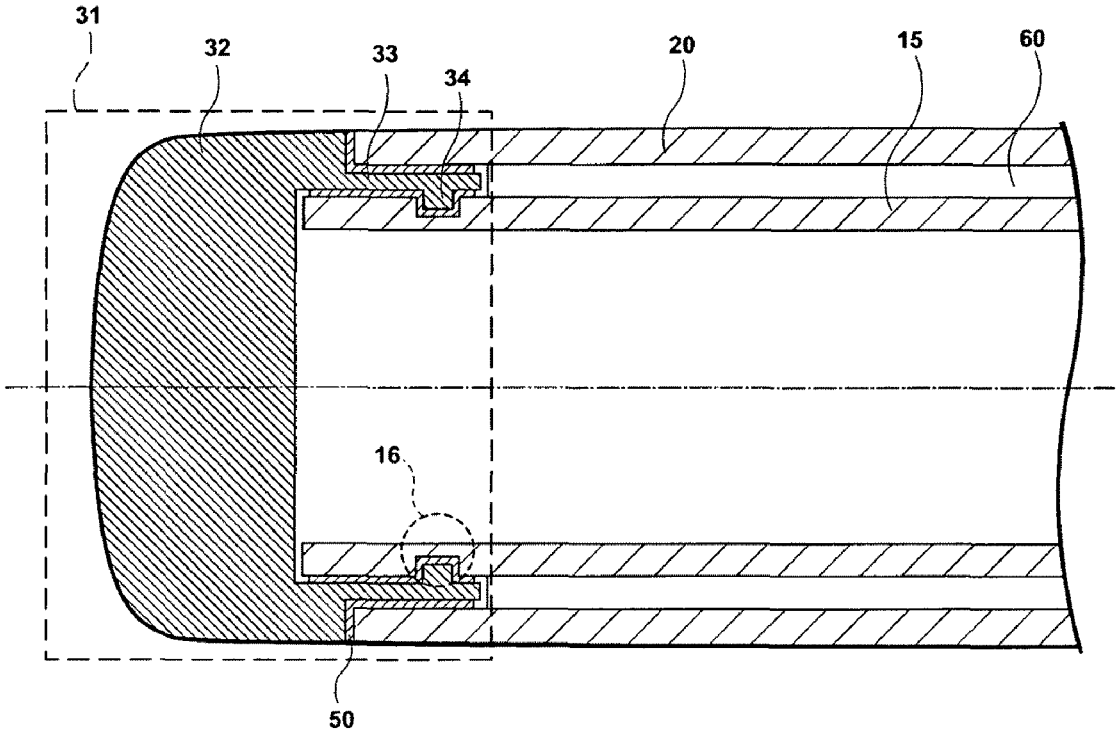
FIG. 2 is an enlarged cross sectional view of the cap part of the fixing component of the bat used for baseball or softball relating to the first embodiment of this invention.
Figure 3:
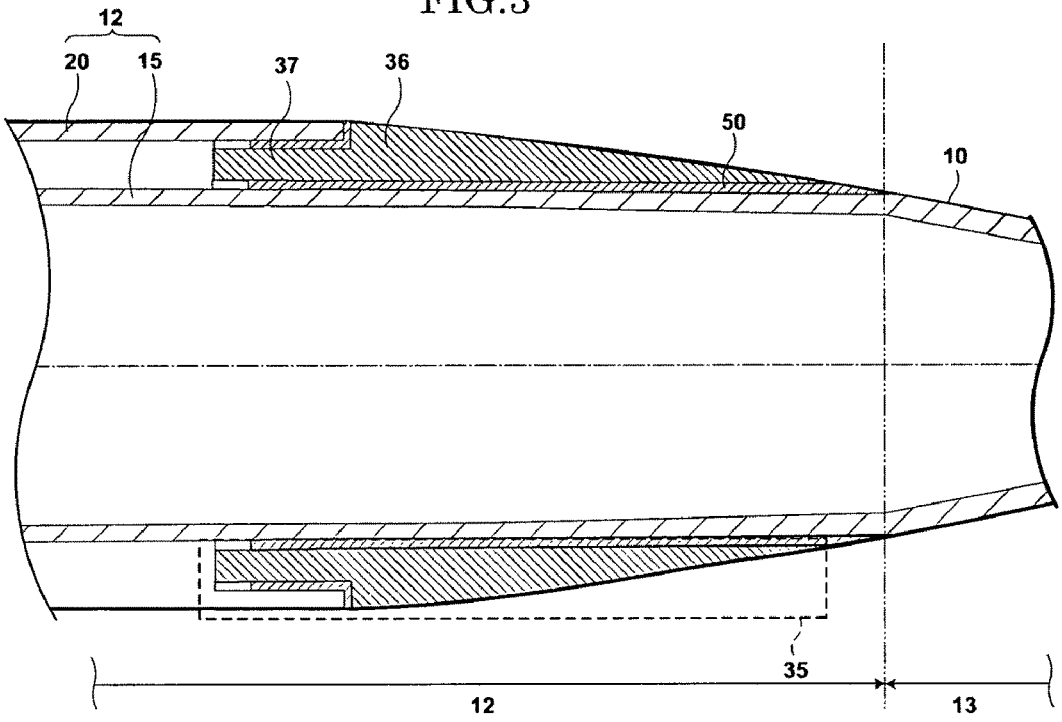
FIG. 3 is an enlarged cross sectional view of the rib part of the fixing component of the bat used for baseball or softball relating to the first embodiment of this invention.

The fixing components 30 will be explained based on FIGS. 2 and 3. FIG. 2 is an enlarged cross sectional view of the first fixing component 31 of the fixing components 30. Also, FIG. 3 is an enlarged cross sectional view of the second fixing component 35 of the fixing components 30.

As is shown in FIG. 2, the first fixing component 31 of the fixing components 30 is inserted between second tube 20 and the first tube 15 of the part corresponding to the tip part of the bat body.

The first fixing component 31 of the fixing components 30 is formed from a body part 32 and an insertion part 33 which is inserted between the bat body and the second tube and a protrusion part 34 is arranged on the part that faces the bat body on the insertion part. In embodiment one of this invention the first fixing component 31 composes the bat's cap.

The body part 32 of the first fixing component 31 has a cylindrical form and whose diameter has been gradually narrowed towards the tip, is inserted in the tip of the bat body and forms the tip part 11 of the bat itself. Also, when the bat is thrown following a hit, the first fixing component 31 makes contact with the ground first and thus performs the role of preventing damage etc to the part to be hit.

The insertion part 33 of the first fixing component 31 is formed by a hollow ring shape which has a predetermined thickness (in other words a donut shape) and where the external diameter of the insertion part 33 is smaller than the external diameter of the first fixing component main part 32. As clearly shown in the cross sectional view of FIG. 2, a protrusion part 34 is formed at a predetermined position on the inner side (the part which faces bat body) of the hollow ring shaped insertion part 33. The protrusion part 34 is interlocked with interlocking grooves 16 of a predetermined width which are formed at a predetermined position close to the end of the outer surface side of the bat body, and prevents the first fixing component 31 from falling out of the bat body. Also, the first fixing component 31 performs the role of fixing the second tube 20 to the outer circumference of the first tube 15 of the bat body by interlocking the protrusion part 34 with the interlocking grooves 16. Also, when a ball is hit, the second tube 20 bends inwards to the inner side as a support point for the insertion part 33 and as well as controlling the consumption of impact energy as ball transformation energy as a repelling force the rebound force of the second tube itself makes the ball travel far. Therefore, the insertion part 33 of the first fixing component 31 performs the role of a support point for the spring of the second tube 20.

The thickness of the insertion part 33 is a thickness in order to maintain the gap 60 which is formed between the bat body and the second tube at a predetermined interval and the combined thickness of this insertion part 33 and adhesive 50 becomes the interval of the gap 60 between the bat body and the second tube 20. In embodiment one of this invention, the interval of the gap 60 is set at, for example, 0.1 mm-3.00 mm depending on the material etc of the bat body and the second tube 20. This width is set because the rebound characteristic of the second tube and bat body is different depending on the material used and because there is a need to maintain an interval which corresponds with the size of the bending towards the inner side of the second tube when the ball is hit. Furthermore, the above stated gap interval is one example and is not limited to this.

In the first fixing component 31 of the fixing components 30, a protrusion part 34 which is formed in the insertion part 33 of this first fixing component 31 as stated above is interlocked and latched with interlocking grooves 16 of a predetermined width formed in the first tube 15 of the bat body, however, because centrifugal force acts upon the second tube 20 when the bat is swung, to make doubly sure the bat body and the second tube 20 is joined to the first fixing component using an adhesive 50 and latched.

The second fixing component 35 of the fixing components 30 in FIG. 3 is formed from the second fixing component main body 36 and an insertion part 37 which is inserted between a first tube 15 of the bat body 10 and a second tube 20.

The second fixing component main body part 36 of the second fixing component 35 shown in FIG. 3, has the same curve as the taper part 13 of the bat body 10 and has a cylindrical shape whose diameter narrows towards the direction of the grip part (not shown) of the bat body 10. Therefore, the second fixing component 35 has a constant total length and this length is different according to the design of the bat body. The second fixing component 35 is latched in a position close to the boundary between the first tube 15 of the bat body 10 and the taper part 13. The latch position of the second fixing component 35 is different according to design and can be placed on the taper part 13 of the bat body 10 and latched. By this second fixing component 35 and the above stated first fixing component 31, the second tube 20 is latched to the outer circumference of the first tube 15 of the bat body 10 and forms a part to be hit (hit area) 12 which has a double composition.

As is shown in FIG. 3, the insertion part 37 of the second fixing component 35 is formed by a hollow ring shape (in other words a donut shape) which has a predetermined thickness and where the external diameter of the insertion part 37 is smaller than the external diameter of the second fixing component main part 36. The thickness of the insertion part 37, similar to the insertion part 33 of the first fixing component 31, is a thickness in order to maintain the gap 60 which is formed between the bat body 10 and the second tube 20 at a predetermined interval. Furthermore, the effects where the insertion part 37 of the second fixing component 35 performs the role of a support point for the spring of the second tube 20, are the same as the insertion part 33 of the first fixing component 31 stated above.

The fixing component 30 which consists of a type of construction as stated above, firstly, performs a role which forms a predetermined gap between the first tube 15 of the bat body 10 and the second tube 20. Also, secondly, it performs a role which latches the second tube 20 to the outer circumference of the first tube 15. Thirdly, particularly because the second fixing component main body 36 of the second fixing component 35 is placed between the second tube 20 and the taper part 13 of the bat body 10, the second tube 20 shifts when the bat is swung and performs the role of preventing a metal sound occurring when the bat body 10 is hit. The third effect will become noticeable in the case of the shape of the bat body 10 in an embodiment different to embodiment one of this invention stated below.

The fixing component 30 stated above is formed by a plastic such as polyurethane, polyamide or polyethylene or synthetic rubber or another elastomer material. However, the material of the fixing component 30 is not limited to these. The material of the fixing components 30 can also be a synthetic resin, metal or ceramic etc.

The adhesive 50 in FIG. 1 is used when latching the bat body 10 and the second tube 20 using the fixing component 30 so that a predetermined gap 60 is formed and performs the role of bonding each composition part material.

The gap 60 in FIG. 1 is formed by inserting the fixing component 30 between the bat body 10 and the second tube 20 as stated above. The gap 60 is located in between the second tube 20 and the first tube 15 of the bat body 10 and is the space for performing the role of controlling the consumption of impact energy as ball transformation energy when the second tube 20 bends towards the inner part side when the ball is hit.

The effects of the bat used for baseball or softball relating to embodiment one of this invention by the construction stated above will be explained. Firstly, in the bat relating to the first embodiment of this invention, by sufficiently transmitting the bat's energy to the ball it is possible to extend flight distance. That is to say, because it has a double layer construction, even when the second tube 20 is thinly formed it is possible to secure strength over along the whole bat. Also, when forming the double layer construction of the second tube 20 and the first tube 15 of the bat body 10, it is formed so that it includes a predetermined gap 60 via a fixing component 30 which has an insertion part (33 and 37) which is formed at a predetermined thickness. Therefore, consumption of impact energy as ball transformation energy when the second tube 20 bends towards the inner part side when the ball is hit is suppressed. Therefore it is possible to sufficiently transmit bat energy into ball energy.

Secondly, the rebound characteristics of the bat relating to the first embodiment of this invention are excellent. That is to say, when the ball hits the bat relating to embodiment one of this invention consumption of impact energy as ball transformation energy is suppressed by the second tube 20 bending towards the inner side. Rebound force is generated by this bending and this rebound force is transmitted to the ball. Further, because the bat body 10 and the second tube 20 relating to embodiment one of this invention are separately formed, heat treated separately and used, it is possible to form the second tube 20 of a different metal material to that of the bat body 10. Therefore, when the second tube 20 is formed from titanium or a titanium alloy which excels in rebound characteristics, the effects increase further.

The rebound characteristics stated above will be explained based on the diagrams. FIG. 10 is a diagram which collates the results of impact test data of a conventional single layer bat, an internal reinforced double bat (a double layer bat which latches a reinforced tube in the inner side of a bat body using a swaging process etc) and a bat used for baseball or softball relating to embodiment one of this invention in a chart. FIG. 11 illustrates this in a bar graph. Further, FIG. 10(*a*) is a graph illustrating the bat's specifications. Also, FIG. 10(*b*) is a graph illustrating the meet ratio which removes the speed of the ball after it has been hit by the speed of the bat swing. Also, FIG. 11(*a*) shows each bat's meet ratio in a graph and FIG. 11(*b*) shows each bat's meet ratio compared to a single layer bat in a graph. In FIG. 10, two varieties of bats are tested, a bat with a thin body and a bat with a thick body concerning the bat relating embodiment one of this invention. The test method uses a rubber softball number 3, 4 types of bat, a ball is hit using a tee-batting method and the bat swing speed and ball speed (below the ball speed is written as B/S) after it has been hit is measured. Using each bat a ball is hit ten times and the average speed is illustrated in the graph.

In FIG. 10(*b*), the meet ratio, which is the hit result, removes the speed of the ball which has been hit, by the speed of the swing of the bat and shows whether the bat swing speed has been efficiently transmitted to the ball. This meet ratio is a way of thinking incorporated not only with bat's used in baseball but also, for example, with golf clubs, and shows whether the swing speed of the club or bat is efficiently transmitted to the ball. If the meet ratio is more than 1.0, the ball travels at an initial speed more than the bat swing speed and, for example, illustrates the contribution of the rebound force etc of the bat itself. Both the bats No. 2 and No. 3 relating to the first embodiment of this invention in FIG. 10 have a meet ratio more than 1.0 namely 1.05 and 1.04, and it is clear that the rebound force of the bat itself is being efficiently transmitted to the ball. This point also appears in FIG. 11(*a*). On the other hand, bat No. 1, which is a conventional single layer bat, is understood to be loosing energy with a low meet ratio of 0.95. Bat No. 4 which is a conventional reinforced inner tube type double layer bat has a meet ratio of 1.0 and compared to a single layer bad is a good ratio, however, it is not providing an initial speed more than the bat swing speed to the ball. It is clear from FIG. 10 that the rebound force of the whole bat relating to embodiment one of this invention has increased.

Also, according to FIG. 11(*b*), it is possible to understand that the meet ratio of bats No. 2 and No. 3 which are bats relating to embodiment one of this invention, has markedly improved compared to the meet ratio of a single layer bat. It is possible to understand that the rebound characteristics of the bat relating to embodiment one of this invention are excellent.

The third effect of the bat relating to embodiment one of this invention is that because the second tube (outer tube) itself is metal, compared to the hybrid type double layer bat, instances of a pop fly or a big ground ball hit with an large incidence angle towards the ground are few.

Figure 7:
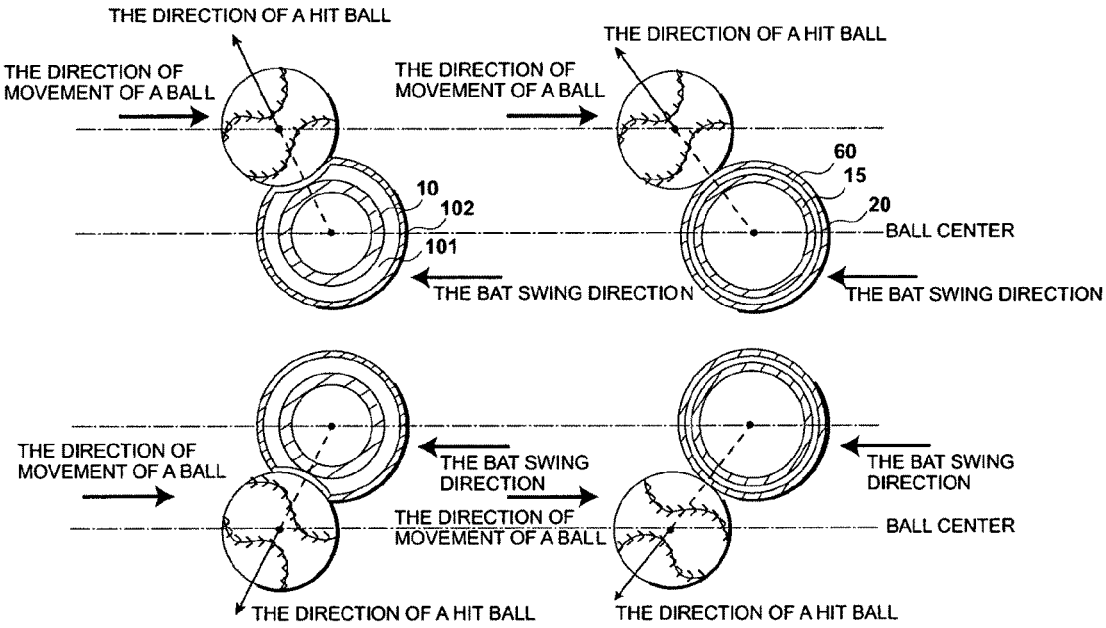
FIG. 7 is a pattern view of the case where a bat does not hit the center of a ball wherein the bat is conventional hybrid type double layer bat and a bat relating to the first embodiment of this invention.
Figure 8A:
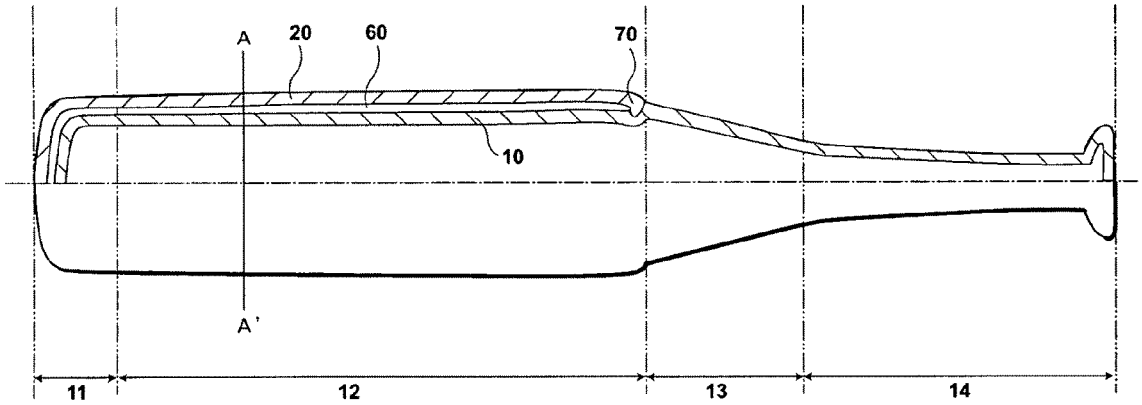
FIG. 8 is a notch sectional view in a longitudinal direction and a cross sectional view of the line A-A' across the width of one example of the conventional double layer bat.
Figure 8B:
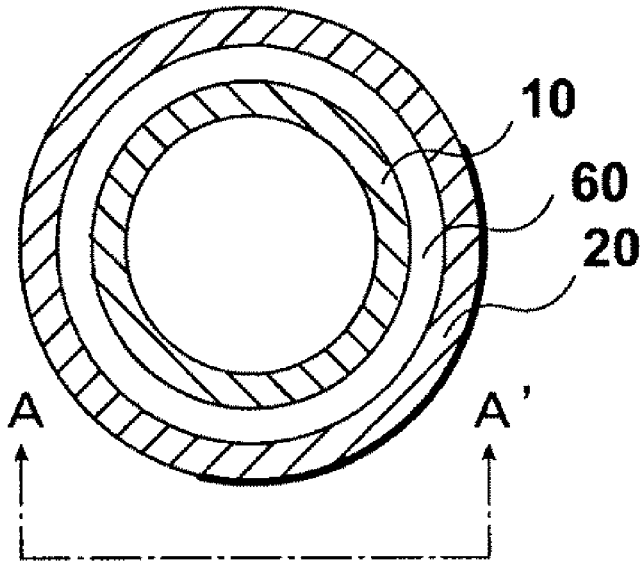
Figure 9A:
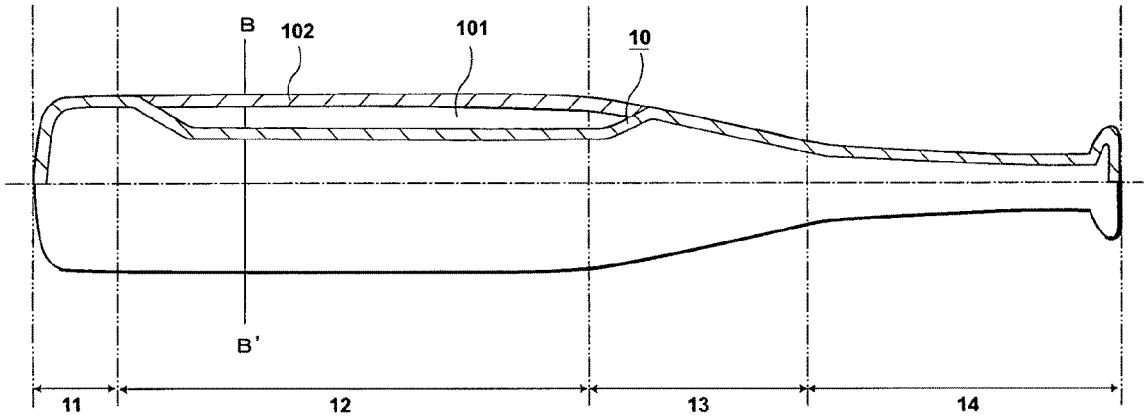
FIG. 9 is a notch sectional view in a longitudinal direction and a cross sectional view of the line B-B' across the width of the conventional hybrid type double layer bat.
Figure 9B:
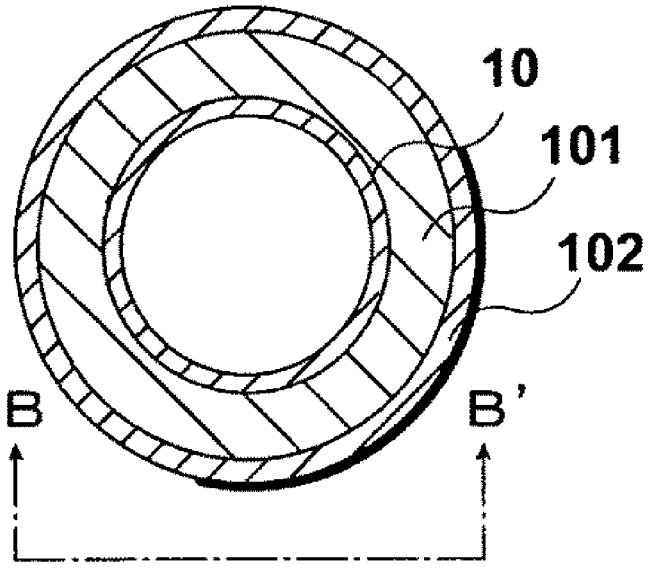

FIG. 7 is a patterned view in the case when the ball is not hit in the center using a hybrid type double layer bat and a bat relating to embodiment one of this invention. The hybrid type double layer bat of this embodiment has a thin shaped body, the outer circumference of the bat body is covered with two layers of urethane and when the diameter of the bat is 57 mm, for example, the diameter of the bat body is a diameter minus the thickness of the urethane layer×2. Because the urethane layer is, for example, about 13 mm, the diameter of the body of the hybrid type bat becomes, for example, about 31 mm. Therefore, in the case where a ball is hit, for example, 15 mm above or below the center of the bat, in the case of a usual single layer and double layer bat it is hit at a position of, for example, about 13.5 mm from the bat's outer circumference area. On the other hand, in the case of a hybrid type double layer bat, while (a ball) is similarly hit at a position of about 13.5 mm from the outer circumference part, this position also includes the thickness of the two layers of urethane (101 and 102) and because the urethane layers (101 and 102) absorb the ball transformation energy at the time of ball impact and contract, actually, there is no real difference between hitting (the ball) at almost the outer circumference area of the bat body 10. Consequently, as shown in FIG. 7, instances of pop fly or a big ground ball hit with a large incidence angle towards the ground, increase. On the other hand, in the bat relating to embodiment one of this invention, the second tube 20 bends thinly towards the inner side at the time of ball impact and because this size is a few millimeters, the instances of pop fly or a big ground ball hit with an large incidence angle towards the ground are few compared to the hybrid type double layer bat. Furthermore, the diameter of the bat stated above is one example and not limited to this.

In addition, the fourth effect of the bat relating to embodiment one of this invention, is that the life cycle is markedly long. While the bat relating to embodiment one of this invention has a metal double layer construction, because the second tube 20 is joined by an adhesive 50 via a fixing component 30 and latched, it is possible to easily replace just the second tube 20 which is easy to damage. In a conventional bat which has a metal double layer construction, even when the outer tube 20 (or the inner tube) was damaged it could not be replaced. The bat relating to embodiment one of this invention has a markedly long life cycle by replacing the second tube 20.

Furthermore, because the second tube of the bat relating to t embodiment one of this invention is made from metal, the effects of the passage of time are extremely few and compared to the hybrid type double layer bat its durability is excellent.

Figure 4A:
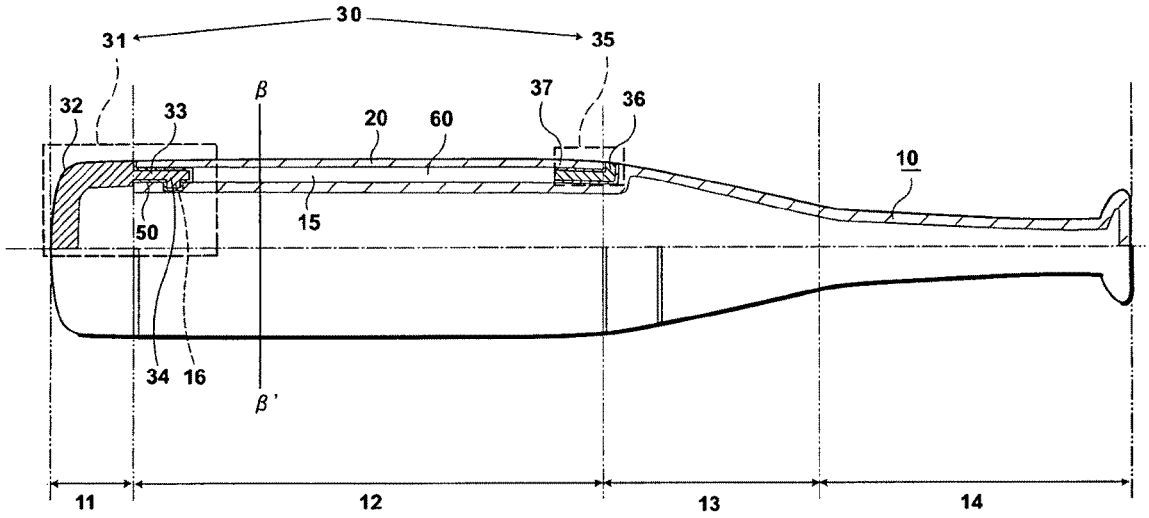
FIG. 4 is a notch sectional view in a longitudinal direction and a cross sectional view of the line β-β' across the width of the bat used for baseball or softball relating to an example of the first embodiment of this invention.
Figure 4B:
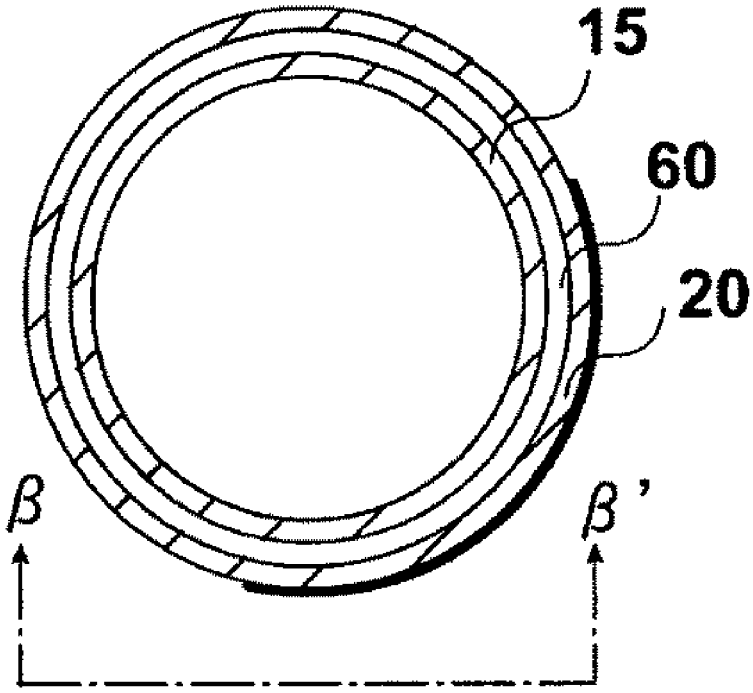

Another embodiment of the bat relating to embodiment one of this invention will be explained. The bat body 10 as shown in FIG. 1 in embodiment one of this invention is formed by a first tube 15 which is extended at a predetermined length towards the bat tip end from the widest part of the taper part 13, a second tube 20 is latched to the outer circumference of the first tube 15 of the bat body 10 by an adhesive 50 via a fixing component 30. In order to more surely carry out this latch, it may be possible to arrange a step between the taper part 13 and the first tube 15 of the bat body 10. FIG. 4 is a notch sectional view in a longitudinal direction and a cross sectional view of the β-β' line across the width of the bat used for baseball or softball relating to another embodiment of the bat relating to embodiment one of this invention.

Because the bat construction in FIG. 4 is the same as that of embodiment one of this invention an explanation will be omitted. The diameter of the first tube 15 of the bat body 10 has been narrowed to less than the largest diameter of the taper part 13. That is to say, in the bat relating to embodiment one, the widest part of the taper part 13 is extended towards the tip part and the first tube 15 is formed, however, in this embodiment, the widest part of the taper part 13 is not extended towards the tip part at this diameter, the diameter at this part is narrowed by a swaging process etc and this narrowed diameter is extended towards the tip and the first tube 15 is formed. Therefore, the external diameter of the first tube 15 is smaller than the largest diameter of the taper part 13. This narrowed down predetermined length corresponds to the total thickness of the second tube 20, the insertion part (33 and 37) of the fixing component 30 and the adhesive 50.

The second tube 20 is latched to the outer circumference of the first tube 15 of the bat body 10 by an adhesive 50 via a fixing component 30, however, a force, which shifts to the tip side by centrifugal force when the bat is swung, is working in the second tube 20. Therefore, by arranging interlocking grooves 16 in the bat body 10 and also arranging a protrusion part 34 in the first fixing component 31 the latch of the first fixing component 31 of the fixing component 30 is strengthened. On the other hand, because the above stated centrifugal force does not work in the second fixing component 35, it is latched using only an adhesive 50. In order to strengthen the latch of the second tube 20 across the whole bat a step is arranged between the taper part 13 and the first tube 15 of the bat body 10 by narrowing the diameter and the shift of the second tube 20 due to centrifugal force when the bat is swung is prevented by this step and the fixing component 30. The second fixing component main body 36 of the second fixing component 35 of the fixing component 30 has a minimum size and forms an L shape form with the insertion part 37. The second tube 20 is joined to the outer circumference of the first tube 15 of the bat body 10 by an adhesive 50 via the fixing component 30 and latched.

In this embodiment, although the form of the bat body 10 and embodiment one of this invention are different, because the second tube 20 is latched with a predetermined gap 60 to the outer circumference of the first tube 15 of the bat body 10 via the fixing component 30, the effects of the bat used for baseball or softball relating to the present embodiment are the same as those of embodiment one of this invention.

Figure 5:
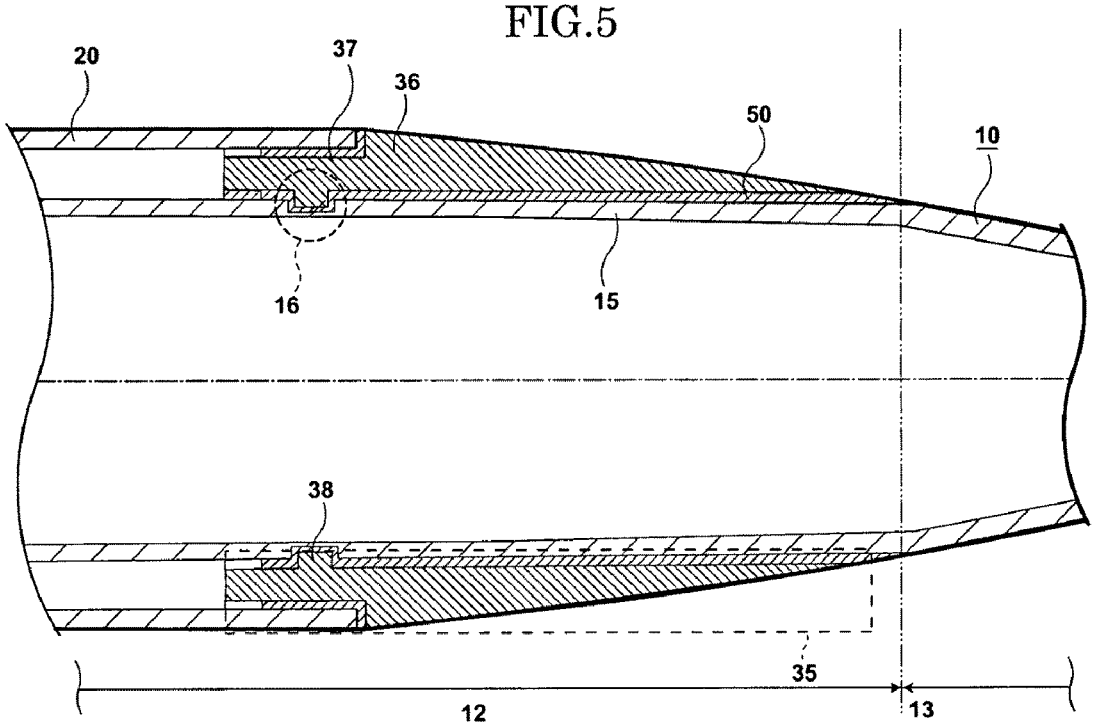
FIG. 5 is an enlarged cross sectional view of a different example of the rib part of the fixing component of the bat used for baseball or softball relating to the first embodiment of this invention.

Also, as another method to further strengthen the latch of the second tube 20, the latch of the second fixing component 35 of the fixing component 30 is the same as the latch of the first fixing component 31. It is possible to arrange interlocking grooves 16 in a position which latches the second fixing component 35 of the bat body 10 and arrange a protrusion part 38 in the second fixing component main body 36 of the second fixing component 35. FIG. 5 is an enlarged cross sectional view of a rib part of a fixing component in the case where an interlocking groove and protrusion part are used in embodiment one of this invention.

In FIG. 5, interlocking grooves 16 are arranged in a predetermined position of the first tube 15 of the bat body 10, and a protrusion part 38 is formed in a predetermined position in the second fixing component main body 36 of the second fixing component 35 of a fixing component 30. By interlocking the interlocking grooves 16 with the protrusion part 38 by an adhesive 50 a latch is further strengthened.

The latching method of the second fixing component 35 of the fixing component 30 as stated above can be applied to a different embodiment than embodiment one of this invention shown in FIG. 4.

Further, although not shown, in the case of further strengthening the latch, it is possible to arrange at least one or more interlocking grooves 16 on the second tube 20 and arrange a protrusion part on the side which faces the second tube of either the first fixing component 31 or the second fixing component 35 or both and latched by an adhesive after interlocking.

Embodiment Two

In the bat used for baseball or softball relating to embodiment one of this invention a second tube and the bat body are formed separately and because they are formed as one unit after each has been heat treated it is possible to form the second tube with the same material as the bat body and it is possible to form it with a material which has excellent rebound characteristics which are different from the bat body. However, because the entire length of the second tube itself becomes almost the same as the entire length of the first tube of the bat body, in the case where the second tube is formed, for example, with titanium which has excellent rebound characteristics, it is difficult to avoid an increase in costs. According to embodiment two of this invention while suppressing an increase in costs as much as possible, it is possible to efficiently transmit bat energy to a ball, and a bat which is used for baseball or softball is proposed which has excellent rebound characteristics and can extend the flight distance of a ball.

Figures 6A, 6B:
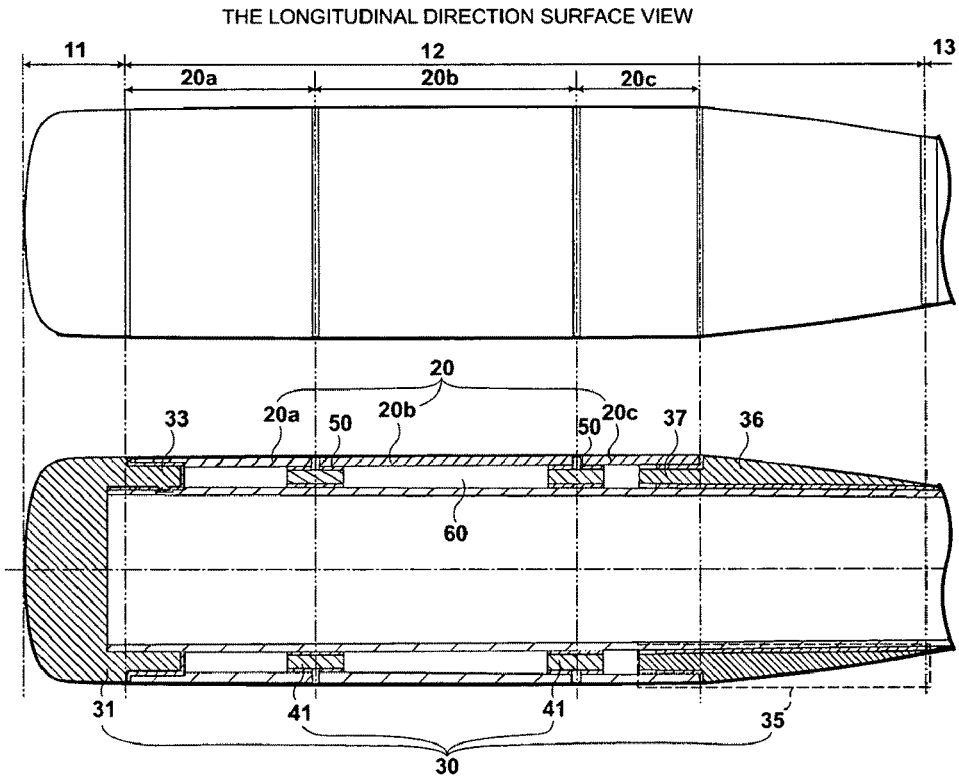
FIG. 6 is a cross sectional view in a longitudinal direction and a surface view of the bat used for baseball or softball relating to the second embodiment of this invention.

The bat used for baseball or softball relating to embodiment two of this invention will be explained based on the drawings. FIG. 6 is a cross sectional view in a longitudinal direction and a surface view of a bat used for baseball or softball relating to embodiment two of this invention. The bat relating to embodiment two of this invention comprises a plurality of tubes wherein a second tube 20 is placed on the outer circumference of a first tube 15 of the bat body.

Because the composition of the bat body in FIG. 6 (not shown) is the same as the bat relating to embodiment one of this invention, a detailed explanation will be omitted. The first tube 15 of the bat body can be formed the same as the bat relating to embodiment one of this invention by the widest part of the taper part 13 of the bat body extending towards the tip part or the same as a different embodiment to embodiment one of this invention shown in FIG. 4 where the diameter from the taper part 13 of the bat body is narrowed and this narrowed diameter is extended towards the tip part.

A characteristic part of the bat relating to embodiment two of this invention is that the second tube 20 comprises a plurality of tubes as stated above. FIG. 6 shows an example formed by three tubes, a second tube A20*a*, a second tube B20*b* and a second tube C20*c*. Each of the second tubes 20 has a cylindrical shape with both ends open. The second tube A20*a* and the second tube C20*c* are formed the same as the bat body, from an aluminum alloy or steel alloy. On the other hand, the second tube B20*b* is the part where when a ball is hit the ball travels furthest, otherwise known as the sweet spot, and while having high costs is formed from titanium or a titanium alloy which has excellent rebound characteristics. Further, either the second tube A20*a* or the second tube C20*c* can be formed from the same material as the second tube B20*b*. As a result, at least one tube of the three tubes (20*a*, 20*b*, 20*c*) is formed from a different material from the other tubes. In this way, because it is possible to use titanium etc which has excellent rebound characteristics and a high cost only in the required places of the part to be hit 12 which hits a ball, it is possible to suppress as much as possible an increase in the costs of the entire bat relating to embodiment two of this invention. Further, the material used for the second tube A20*a* and the second tube C20*c* do not have to be the same material. It is possible to change the material so that one tube is an aluminum alloy and the other tube is a steel alloy.

The three second tubes 20 (20*a*, 20*b*, 20*c*) are each formed as independent tubes at a predetermined length. Further, they are separately heat treated and a predetermined strength is secured and used.

The three second tubes 20 (20*a*, 20*b*, 20*c*) are latched by the fixing component 30 of the bat body. The fixing component 30 consists of a first fixing component 31, a second fixing component 35 and a third fixing component 41. Because the function etc of the first fixing component 31 and the second fixing component 35 are the same as those of embodiment one of this invention their explanation is omitted.

The three second tubes 20 are latched to the first tube 15 of the bat body in order from the direction of the taper part 13, second tube C20*c*, second tube B20*b* and second tube A20*a*. At this time, between both the second tube C20*c* and the second tube B20*b* and between the second tube B20*b* and the second tube A20*a*, a cross section is connected via the convex third fixing component 41. The third fixing component 41 is inserted between the bat body and the second tube 20 the same as the first fixing component 31 and the second fixing component 35 and forms a predetermined gap 60 between the bat body and the second tube 20 and also performs the role of a support point for the spring of the second tube 20. Further, the third fixing component 41 is also formed from the same material as the other fixing components.

The cross section of the third fixing component 41 is formed convexly because the convex shape protrusion part is inserted between the second tube C20*c* and the second tube B20*b* and between the second tube B20*b* and the second tube A20*a* and by directly connecting each of the pairs of second tubes 20 (second tube C20*c* and the second tube B20*b*, second tube B20*b* and the second tube A20*a*), generation of a metal sound is prevented. Also, the second tube B20*b* is placed in the middle of the three second tubes 20, however, the third fixing component 41 performs the role of latching the second tube B20*b* with the bat body so that a gap 60 of a desired thickness is formed. Consequently, the thickness of the under section of the convex shaped third fixing component 41 is formed so that it becomes the same thickness as the desired thickness of the gap 60 in the case where the thickness of the adhesive 50 is added.

The latch of the three second tubes 20 will be explained. In the three second tubes 20, first, one end of the second tube C20*c* and one end of the second tube B20*b*, the other end of the second tube B20*b* and one end of the second tube A20*a* are connected by an adhesive 50 via the third fixing component 41. Next, the second fixing component 35 of the fixing component 30 is joined to the bat body using the adhesive 50. After applying the adhesive 50 to the inner side (the part facing the side of the bat body) of the third fixing component 41 of the three connected second tubes 20 by the above stated process, the bat body which is joined to the second fixing component 35 of the fixing component 30 is inserted into the second tubes 20. The insertion part 33 of the first fixing component 31 of the fixing component 30 to which is applied the adhesive 50, is inserted between the second tube A20*a* and the bat body and the convex shape protrusion part 34 of the first fixing component 31 is interlocked with the interlocking grooves 16 of the first tube 15 of the bat body, joined and latched.

The effects of the bat relating to embodiment two of this invention are that it is possible to use titanium etc which has excellent rebound characteristics in the central position (that is the part to be hit) of the second tubes 20 while suppressing as much as possible a rise in costs as stated above and a bat can be proposed with excellent rebound statistics.

Also, because the bat relating to embodiment two of this invention is comprised from the three second tubes 20 (20*a*, 20*b*, 20*c*) as stated above, it is possible to easily replace only the second tube (20*a*, 20*b*, 20*c*) which is damaged among the three tubes (20*a*, 20*b*, 29*c*) and it is possible to markedly lengthen the life cycle. Also, particularly because it is possible to replace only the second tube B20*b* which is easy to damage after hitting a ball frequently, when compared to the bat relating to embodiment one of this invention it is possible to lengthen the life cycle while suppressing maintenance costs.

Also, the bat relating to embodiment two of this invention the same as the bat relating to embodiment one of this invention, has a desired gap 60 between the bat body and the second tube 20 and the second tube 20 is joined to the bat body using a fixing component 30 and latched. Therefore, similar to the bat used for baseball or softball relating to embodiment one of this invention it has the following effects; it is possible to efficiently transmit bat energy to a ball, it has excellent rebound characteristics, instances of pop fly or a big ground ball hit with a large incidence angle towards the ground, are few compared to a hybrid type double layer bat and it is able to secure an excellent durability compared to a hybrid type double layer bat.

Further, also in the bat relating to embodiment two of this invention, the same as the bat relating to embodiment one of this invention a convex shaped protrusion part 38 can be arranged in the second fixing component 35 and an interlocking groove 16 can be arranged in a position which accommodates the first tube 15 of the bat body, interlocked and latched Also, it is possible to arrange a interlocking groove 16 on the second tube 20 and a convex protrusion part also on the side which faces the second tube of the corresponding fixing component 30 so that it is interlocked and latched.

What is claimed is:

1. A bat used for baseball or softball comprising;

a bat body including a grip part, a taper part and a first tube and having at least one or more interlocking grooves;

a cylindrical second tube having two ends, the inner diameter of said cylindrical second tube being larger than the diameter of said first tube of said bat body, said second tube is placed on the outer circumference of said first tube of said bat body; and a fixing component including a first fixing component and a second fixing component which latches said second tube to said bat body so that a gap from 0.1 mm to 3.0 mm is formed between said second tube and said bat body so that said second tube bends inwards and contacts with said first tube when a ball is hit, said fixing component performing the role of a support point when said second tube bends inwards when a ball is hit, wherein said at least one or more interlocking grooves interlock with said fixing component and one of said interlocking grooves is formed at a predetermined position close to an end of an outer surface side of said bat body.

2. The bat for baseball or softball according to claim 1, wherein said first tube of said bat body is formed by narrowing so that the outer diameter of said first tube becomes smaller than the widest outer diameter of a taper part.

3. The bat for baseball or softball according to claim 1, wherein said bat body and said second tube are each formed separately by metal, and each are separately heat treated and both latched using said fixing component.

4. The bat for baseball or softball according to claim 1, further comprising a cap formed separately from a bat body.

5. The bat for baseball or softball according to claim 1, wherein a part of said first fixing component is a cap for capping a tip side of said bat body.

6. The bat for baseball or softball according to claim 1, wherein said second tube has at least one or more interlocking grooves which interlock with said fixing component.

7. The bat for baseball or softball according to claim 1, wherein said bat body and said second tube are joined using an adhesive via said fixing component and latched.

8. The bat for baseball or softball according to claim 1, wherein said second fixing component has a ring shape with a larger inside diameter than the outer diameter of said first tube.

9. A bat used for baseball or softball comprising:

a bat body including a grip part, a taper part and a first tube;

a fixing component including a first fixing component, a second fixing component and a third fixing component and having at least one or more interlocking grooves; and a plurality of cylindrical second tubes each having two open ends, the inner diameters of said plurality of cylindrical second tubes being larger than the diameter of said first tube of said bat body; at least one of said plurality of cylindrical second tubes being formed from a different material to those of the other cylindrical second tubes, said plurality of cylindrical second tubes being placed on the outer circumference of said first tube of said bat body and being latched so that gaps are formed between said bat body and said plurality of cylindrical second tubes via said first fixing component, said second fixing component and said third fixing component, wherein said bat body has at least one or more interlocking grooves which interlock with said fixing component and one of said interlocking grooves is formed at a predetermined position close to an end of an outer surface side of said bat body.

10. The bat used for baseball or softball according to claim 9, wherein said first tube of said bat body is formed by narrowing so that the outer diameter of said first tube becomes smaller than the widest outer diameter of said taper part.

11. The bat used for baseball or softball according to claim 9, wherein said bat body and said second tubes are each formed separately by metal and each are separately heat treated and latched using said fixing component.

12. The bat used for baseball or softball according to claim 9, further comprising a cap formed separately from said bat body.

13. The bat used for baseball or softball according to claim 9, wherein a part of said first fixing component is a cap for capping a tip side of said bat body.

14. The bat used for baseball or softball according to claim 9, wherein said second tubes have at least one or more interlocking grooves which interlock with said fixing component.

15. The bat used for baseball or softball according to claim 9, wherein said bat body and said second tube are joined using an adhesive via said fixing component and latched.

16. The bat used for baseball or softball according to claim 9, wherein said bat body is formed with an aluminum alloy or alloy steel, wherein said plurality of cylindrical second tubes are formed by either an aluminum alloy, an alloy steel, a titanium alloy, a magnesium alloy, a phosphor bronze, a copper alloy, a gold alloy, or a platinum alloy, respectively; and wherein one of said plurality of cylindrical second tubes is formed with a material in which a rebounding characteristic of said one of said plurality of cylindrical second tubes excels the rebounding characteristics of said other cylindrical second tubes.

17. The bat for baseball or softball according to claim 1, wherein said first fixing component has a protrusion part which is interlocked with said one or more of interlocking grooves and said protrusion part and said one or more of interlocking grooves are interlocked so that said first fixing component is strongly latched with said bat body.

18. The bat for baseball or softball according to claim 9, wherein said first fixing component has a protrusion part which is interlocked with said one or more of interlocking grooves and said protrusion part and said one or more of interlocking grooves are interlocked so that said first fixing component is strongly latched with said bat body.

* * * * *